United States Patent [19]

Kelly

[11] 4,217,952

[45] Aug. 19, 1980

[54] ENERGY SAVING SYSTEM FOR RETRIEVING HEAT LOSS FROM AN ELECTRICAL APPARATUS

[76] Inventor: James V. Kelly, 2416 NW. 44th St., Oklahoma City, Okla. 73112

[21] Appl. No.: 922,961

[22] Filed: Jul. 10, 1978

[51] Int. Cl.[3] ..... B60H 1/00

[52] U.S. Cl. ..... 165/39; 165/47; 165/DIG. 12; 415/179; 361/384

[58] Field of Search ..... 62/181, 238 E, 324 D, 62/428, 507, 508; 165/16, 39, DIG. 12, 47; 415/179; 60/39.18 B; 361/384

[56] References Cited

U.S. PATENT DOCUMENTS

| | | | |
|---|---|---|---|
| 2,293,482 | 8/1942 | Ambrose | 62/238 R |
| 2,376,859 | 5/1945 | Benn | 62/428 |
| 4,007,874 | 2/1977 | Laudner | 62/428 |
| 4,138,859 | 2/1979 | Pietsch | 62/324 D |

*Primary Examiner*—Albert W. Davis
*Assistant Examiner*—Margaret A. Focarino
*Attorney, Agent, or Firm*—Dunlap, Codding & McCarthy

[57] ABSTRACT

In a system having an electrical apparatus dissipating thermal energy, an apparatus compartment is provided to substantially surround the apparatus, and a blower, disposed in an inlet air compartment, forces air through the apparatus compartment to an exiting air directing assembly where the heated air is selectively directed to a building structure, or to the outside atmosphere. A temperature responsive control assembly selectively directs a portion of the exiting air to the building structure. Suction air to the blower is selectively provided from the building structure or from outside air, the selection of which is selected by another temperature responsive control assembly.

8 Claims, 7 Drawing Figures

ENERGY SAVING SYSTEM FOR RETRIEVING HEAT LOSS FROM AN ELECTRICAL APPARATUS

BACKGROUND OF INVENTION

1. Field of Invention

The present invention relates generally to the field of electrical apparatus, and more particularly but not by way of limitation, to an energy saving system for the retrieval of thermal energy loss by an electrical apparatus.

2. Discussion

In a typical industrial plant, certain electrical systems generate a significant amount of thermal energy that is dissipated into the surrounding air. There are some such systems, such as air compressor units, that are usually located externally to the plant; an external location site is selected for such equipment for a variety of reasons, including considerations of space utilization, building environmental capacities, noise levels, and perhaps other considerations. In any event, it is not at all uncommon to find an electrical air compressor and its driving motor located in the outside atmosphere.

Even when such installations are located inside the plant, unless the heat given off can be distributed as required inside the plant, the heat losses of the compressors becomes a real problem, as balanced environmental control of the plant becomes difficult. For a large number of plants, the plant compressor or compressor bank represents the largest single source of heat generation outside of the plant's environmental control system. It is no small consideration then to achieve proper utilization of the waste heat of such air compressors, or at least to provide for efficient heat dissipation therefrom.

SUMMARY OF INVENTION

An energy saving system for transferring heat losses from an electrically driven air compressor apparatus and the like, and to selectively distribute the air heated thereby. An apparatus compartment is provided to substantially enclose the air compressor unit, and a blower directs air into an air inlet port, past the unit, and out an air exiting port, where the air is received by an exiting air directing assembly.

The exiting air directing assembly provides for selectively directing the heated air in a first direction, which may be to a building air distribution system, and in a second direction, which may be as waste heat to the outside atmosphere. A first air control assembly, responsive to a sensed system temperature, selectively directs portions of the air in the first and second directions.

Upstream to the blower, which is disposed at the exhaust port of an inlet air compartment, suction air is provided by a first air inlet port, which may be connected to the building return air system, and a second air inlet port, which may receive air from the outside atmosphere. A second air control assembly, responsive to the temperature of the air exiting the apparatus compartment, selectively provides for air to be drawn by the blower through the first and second air inlet ports.

It is an object of the present invention to provide an energy saving system for the efficient utilization of heat losses given off by electrically driven air compressor units and the like.

Another object of the present invention is to provide an energy saving system to provide for the controlled distribution of heated air surrounding an electrically driven air compressor and the like.

Yet another object of the present invention is to provide an energy saving system that affords a more efficient and controlled environment surrounding an electrically driven air compressor and the like.

A further object of the present invention is to provide an energy saving system that is relatively easy to manufacture and install, and that is inexpensive to operate and maintain.

Other objects, advantages and features of the present invention will be made clear by the following detailed description of the preferred embodiment when read in conjunction with the drawings and appended claims.

DESCRIPTION OF THE PREFERRED EMBODIMENT

Figure 1:
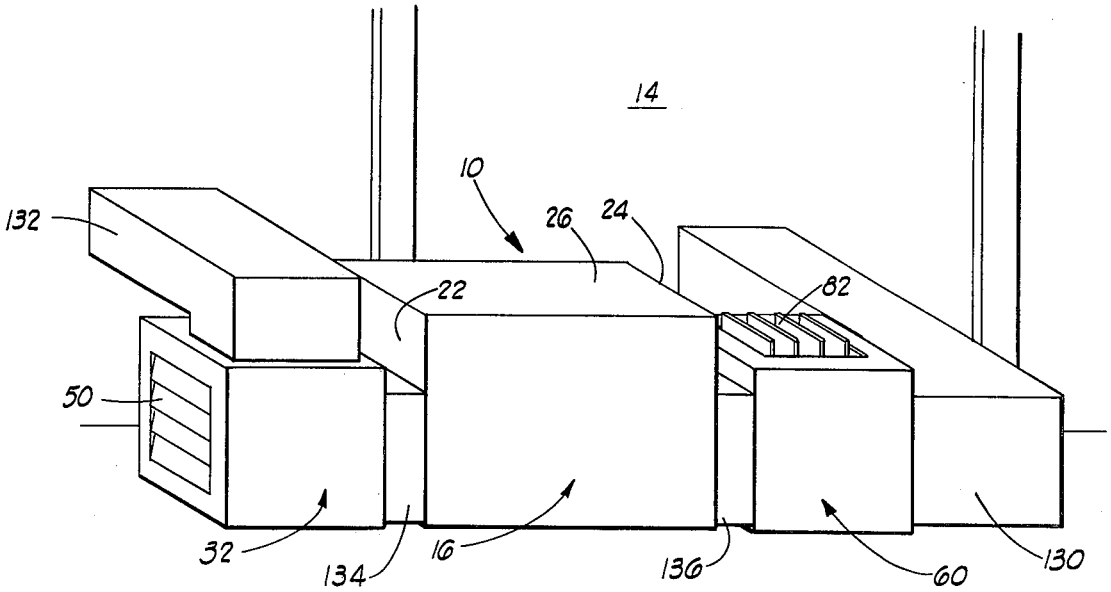
FIG. 1 is an isometric depiction of a typical air compressor unit equipped with the energy saving system of the present invention.

An energy saving system constructed in accordance with the present invention is shown in FIG. 1 and designated therein by the numeral 10. The energy saving system 10 is shown in combination with an electrically driven air compressor unit (not shown) that is supported by a surface 12 outside of a building structure 14.

Figure 4:
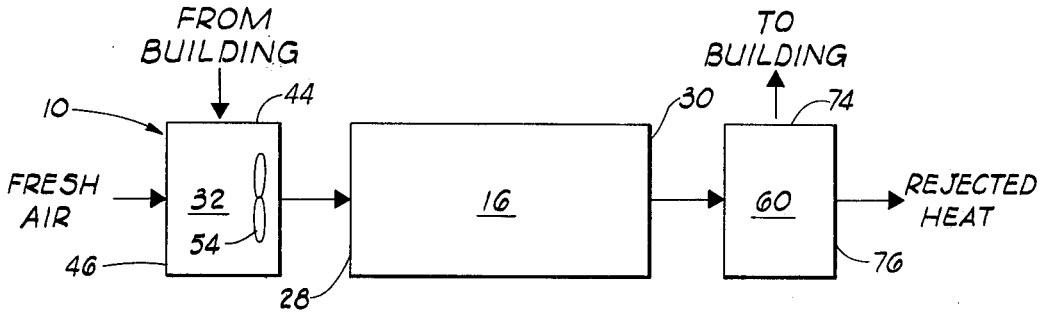
FIG. 4 is a block diagram depicting the components of the energy saving system of FIG. 1 and representing the air flow therethrough.

The energy saving system 10 comprises an apparatus compartment 16 that substantially encloses the air compressor unit, the compartment 16 having side walls 18, 20, end walls 22, 24 and a top panel 26. The end panel has an opening therein that serves as an air inlet port 28 (as depicted in FIG. 4), and the opposite end panel 24 has an opening that serves as an air exiting port 30.

Figure 3A:
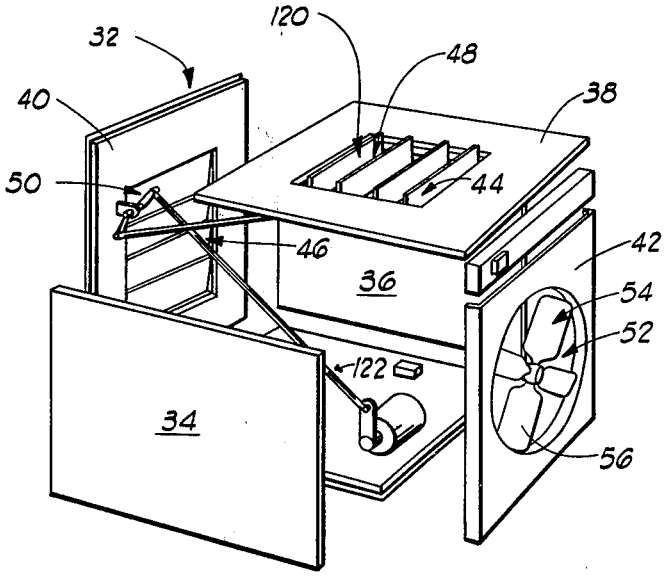
FIG. 3A is an isometric view of the inlet air compartment of the energy saving system of FIG. 1, the view in FIG. 3A showing the damper and blower arrangement therein.

Located next to the apparatus compartment 16 is an inlet air directing assembly comprising an inlet air compartment 32 that is best shown in FIG. 3A. The apparatus compartment 16 is an enclosure having side walls 34, 36, a floor panel (not shown), a top panel 38, and end panels 40, 42. The top panel 38 has an opening that serves as a first air inlet port 44, and the end panel 40 has an opening that serves as a second air inlet port 46. Disposed in the first air inlet port 44 is a first damper 48, and a second damper 50, identical to the first damper 48, is disposed in the second air inlet port 46. Further description of the first and second dampers 48, 50 will be provided below.

The end panel 42 has an opening that serves as an air exhaust port 52, and a blower 54 is supported near the air exhaust port 52 to blow air out of the port 52. The blower 54 is of conventional construction, having a fan unit 56 generally disposed in the air exhaust port 52, and a supporting frame and electric motor drive (not shown).

Figure 2:
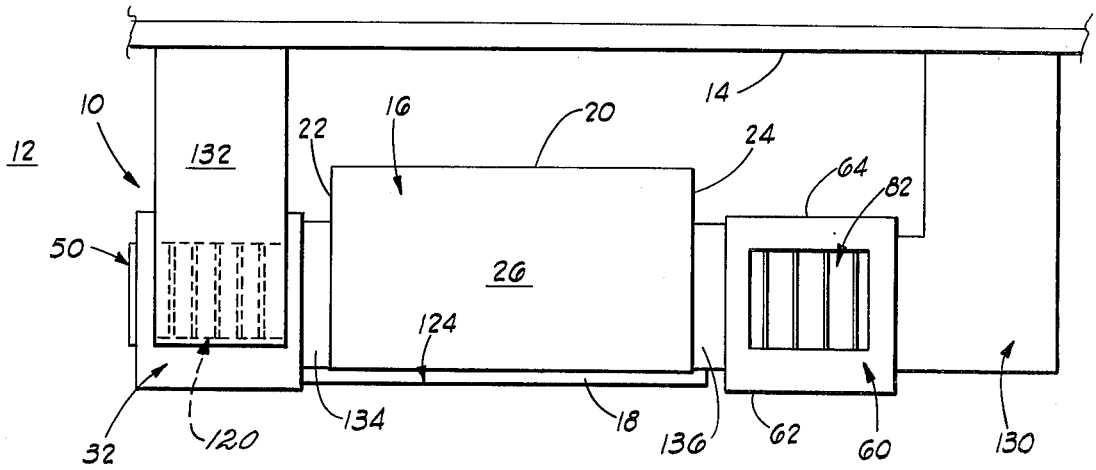
FIG. 2 is a plan layout of the energy saving system shown in FIG. 1.
Figure 3B:
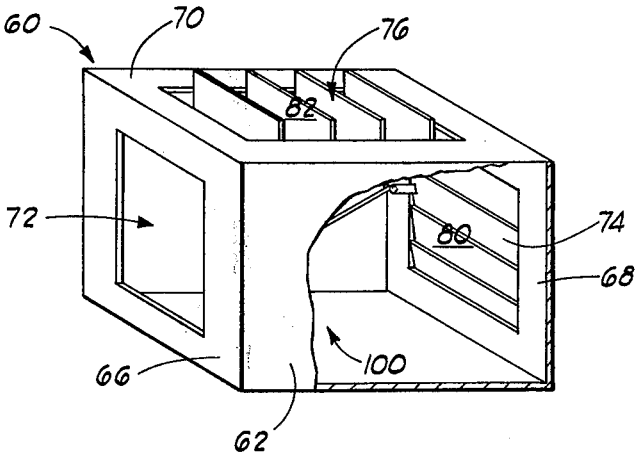
FIG. 3B is an isometric view of the exiting air compartment of the energy saving system of FIG. 1.

Located near the other end of the apparatus compartment 16 is an exiting air directing assembly comprising an exiting air compartment 60, shown in FIGS. 1 and 2, but perhaps best detailed in the view of FIG. 3B.

The exiting air compartment 60 has a pair of opposing side walls 62, 64, a pair of opposing end walls 66, 68, a floor panel (not shown), and a top panel 70. The end wall 66 has an opening that serves as an inlet port 72; the end panel 68 has an opening that serves as a first exhaust port 74; and the top panel 70 has an opening that serves as a second exhaust port 76.

A first damper 80 is disposed in the first exhaust port 74, and a second damper 82 is disposed in the second exhaust port 76. The first and second dampers 80, 82 are identical in construction to that of the previously mentioned dampers 48, 50 that are disposed in the inlet air compartment 32; therefore, a description of the damper 80 with reference to the view of FIG. 5 will suffice as a description for each of the other dampers.

Figure 5:
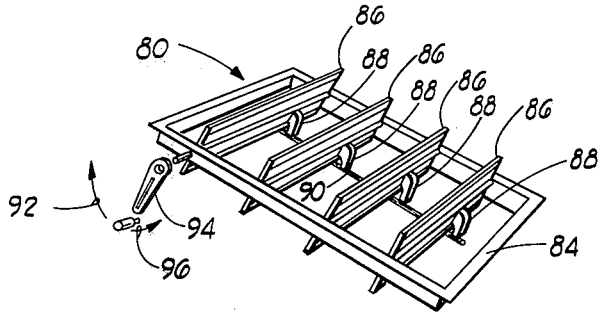
FIG. 5 is a view of one of the dampers utilized in the energy saving system of FIG. 1.

Referring yet to FIG. 5, the damper 80 has a frame 84 shaped to be mounted in the first exhaust port 74 such as by bolts (not shown) or the like. A plurality of louver panels 86 are pivotally mounted in the frame 84, and each panel 86 has an extensive finger member 88, all of the members 88 being pivotally attached to a connector rod 90. The view of FIG. 5 depicts the parallel louver panels 86 in the opened mode; that is, the opening of the frame 84 is opened to its maximum extent. This opening can also be sealed to the passage of air flow by rotating all of the louver panels 86 in the direction indicated by the arrow 92. This rotation is achieved by turning a crank handle 94 that is connected to the mounting arbor or one of the louver panels (as shown) that extends through the frame 84 for this purpose. Accordingly, sufficient rotation of the handle 94 in the direction 92 will effect the rotation of all of the louver panels 86 to position the damper 80 in a closed mode to seal the opening of the frame 84; and rotation of the handle 94 in the opposite direction 96 will position the damper 80 in the opened mode.

Of course, as the louver panels 86 are varied between being fully opened to being fully closed, the effective cross sectional area of the opening in the frame 84 will decrease continually from a maximum effective cross sectional area at the fully opened position to no effective cross sectional area at the fully closed position. The term effective cross sectional area is here defined as that opening area seen by fluid flowing in a conduit substantially normal to the frame 84, and consequently, to the first exhaust port 74 in which the frame 84 is mounted.

Advantage is taken of this variable effective area in controlling the air flow direction in the exiting air compartment 60. As shown in FIG. 3B, the first and second dampers 80, 82 are part of a first air control assembly 100, which is depicted diagrammatically in FIG. 6. The first air control assembly 100 is comprised of the first and second dampers 80, 82 that are connected to a first linkage assembly 100. The first linkage assembly 100 has a reversable drive electric motor 103 that has an arm member 104 variably positionable upon command via an electrical signal input. Pivotally attached to the end of the arm member 104 is a driving arm 106 that is in turn pivotally connected to the crank arm 94 of the damper 80. (For clarity of drawing, a double crank arm 94 is shown for the damper 80, which is one of several possible connections.) Also, a linking member 108 is pivotally attached to the crank arm 94 of the first damper 80, and to the crank arm 94 of the second damper 82.

Figure 6:
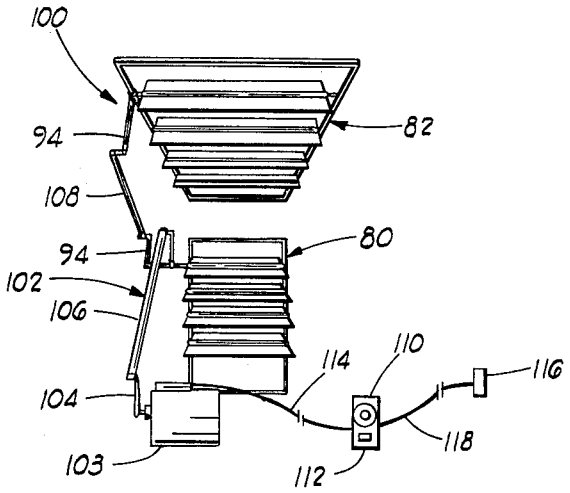
FIG. 6 is a diagrammatical representation of one of the air control assemblies utilized in the energy saving system of FIG. 1.

As depicted in FIG. 6, the first damper 80 is substantially closed, while the second damper 82 is substantially open. This relationship is determined by the linking arm members of the linkage assembly 102. As the motor 103 is energized and its drive shaft caused to rotate in a direction that effects the positioning of the second damper 82 in its closed mode, the first damper 80 is caused to move toward and finally assume its fully opened mode.

To control the operation of the linkage assembly 102, the exiting air directing assembly has a first sensing assembly 110 that has a conventional thermostat 112 connected to a transformer (not shown) via a conductor 114 and to a temperature sensing bulb 116 via a conductor 118. Further description of the thermostat component need not be provided herein; also, for the purpose of simplifying the drawings, other electrical conductors and control devices are not described in detail, as such is not believed necessary for the purpose of this disclosure. It is sufficient to state that the first sensing assembly 110 generates a first signal that is transmitted to energize the electric motor 103 as necessary to effect positioning of the dampers 80, 82 in their desired modes. The sensing bulb 116 of the first sensing assembly 110 is positionable to sense a selected system temperature, and since the thermostat will transmit a first signal responsive to the sensed temperature, the linkage assembly 102 will react in response to the sensed system temperature.

As stated above, the first and second dampers 80, 82 are disposed in the first and second exhaust ports 74, 76 respectively, and it will be evident that the positioning of these dampers in their opened and closed modes will effect the selective opening and closing of the first and second exhaust ports 74, 76. Since the first and second dampers 80, 82 are simultaneously moving, but in reverse directions, it will be clear that the total amount of open flow area remains substantially the same. That is, the effective cross sectional area of the first and second exhaust ports open to air flow remains substantially constant.

Returning to the inlet air directing assembly previously discussed, and which is shown in FIG. 3A, the first and second dampers 48, 50 are part of a second air control assembly 120 that has a second linkage assembly 122 that is identical to the first linkage assembly 102 described above. Therefore, further description of the second linkage assembly 122 need not be included herein except to note that the second linkage assembly 122 is energized by a second signal generated by a second sensing assembly 124 that is substantially equivalent to the first sensing assembly 110 already described. That is, the second sensing assembly 124 senses a selected system temperature and the thermostat of the second sensing assembly 124 relays the second signal to a relay that energizes the electric motor of the second air control means to effect the opening and closing of the second dampers 48, 50, and consequently, the opening and closing of the first and second air inlet ports 44, 46. Thus in like manner to that discussed above for the dampers 80, 82, the effective cross sectional area seen by air flow through the dampers 48, 50 remains substantially constant. As related to the blower 54, this means that the total amount of port area open for suction air is substantially constant and is independent to the rotational positions of the dampers 48, 50.

Having described the above mentioned components of the energy saving system 10, reference is now once more made to FIGS. 1 and 2 in which is shown an exiting air conduit 130 that connects via bolts (not shown) to the exiting air compartment 60 and which extends as shown into the building structure 14. The conduit 130 is disposed to receive air that is passed through the first exhaust port 74. Also shown in FIGS. 1 and 2 is an entering air conduit 132 that connects via bolts (not shown) to the inlet air compartment 32 over the first air inlet port 44. The conduit 132 extends from the building structure 14 and supplies air from the interior of the building structure to the first air inlet port 44. If desired, the conduit 132 can be connected to the air return system of a conventional heating and cooling system.

A pair of connecting conduits 134 and 136 are provided to connect between the inlet air compartment 32 and the exiting air compartment 60, respectively, to the apparatus compartment 16. While it is possible to abut these members directly against each other, the conduits 134 and 136 facilitate installation and serve to pass the air from the air exhaust port 52 to the air inlet port 28 of the apparatus compartment 16, and from the air exiting port 30 to the inlet port 72 of the exiting air compartment 60.

OPERATION

Referring to FIG. 4, a simplified diagrammatical representation of the components that make up the energy saving system 10 described hereinabove; and in FIG. 5, it will be noted that suction air is available from two different air sources to the blower 54 disposed in the inlet air compartment 32. That is, air can enter either or both the first air inlet port 44 and the second air inlet port 46 as controlled by the damper 50. Fresh air from the outside atmosphere can enter the air inlet port 46 when opened by the damper 50; and a second source of air is provided in the form of return air that can enter the air inlet port 44 when opened by the damper 48. As will be discussed below, either one of these sources of air can be used individually, or portions of the two air streams can be mixed in the inlet air compartment 32.

The blower 54 draws air selectively from the first and second air inlet ports 44, 46 and blows the air thorugh the air exhaust port 52 into the air inlet port 28 of the apparatus compartment 16. The air passes through the apparatus compartment 16 in heat absorbing relationship with the electrical apparatus contained in the apparatus compartment 16, which in the preferred embodiment described herein is an electric motor driven air compressor that furnishes compressed air to a plant. The air passing through the apparatus compartment 16 is heated by the thermal heat loss of the motor and compressor, and the heated air passes out the air exiting port 30 and enters the inlet port 72 of the exiting air compartment 60. At this point, the exiting air directing assembly, having received the heated air from the apparatus compartment, selectively directs the heated air in a first direction through the first exhaust port 74 or in a second direction through the second exhaust port 76. As will be made clear below, all of the heated air can be directed through either the first exhaust port 74 or the second exhaust port 76, or portions of the heated air can be directed through the first and second exhaust ports 74, 76 at the same time. That is, the second damper 82 can be directed to close the second exhaust port 76, in which case all of the heated air will be sent through the fire exhaust port 74 to be sent to the plant as conditioning air. On the other hand, the first exhaust port 74 can be sealed to air passage by closing the first damper 80, and all of the heated air entering the exiting air compartment 60 will be exhausted through the second exhaust port and dissipated into the outside atmosphere.

It is contemplated by the present invention that the first sensing assembly 110 will be located such that the sensing bulb 116 will be disposed internally to the building structure 14 so as to sense a selected system temperature within the building structure. As shown in FIG. 2, the second air control assembly 120 is positioned so that the sensing bulb of the second sensing assembly 124 is disposed to sense the temperature of the air exiting the air exiting port 30. Thus the second linkage assembly 122 is responsive to the temperature of the air exiting the apparatus compartment 16.

In the above described layout, the first sensing assembly 110 senses a selected system temperature within the building structure 14 and provides a first signal proportional to the selected temperature. The first signal is transmitted to the first air control assembly 100 that is disposed in the exiting air compartment 60 to selectively direct the heated air either completely through the first exhaust port 74, through the second exhaust port 76, or a portion of the heated air through both of the first and second exhaust ports 74, 76.

The second sensing assembly 124 senses the temperature of the heated air exiting the air exiting port 30 of the apparatus compartment 16, providing a second signal proportional to the temperature of the heated air, the second signal controlling the second air control assembly 120 disposed in the inlet air compartment 32 for controlling which source of suction air is fed to the blower 54. That is, suction air for the blower 54 can be obtained, by way of example, entirely from the building structure 14 in which case all of the air to the blower 54 passes through the conduit 132 to the first air inlet port 44; or the suction air for the blower 54 can be obtained entirely from fresh air entering the second air inlet port 45. Of course, a mixture of building air and fresh air can be achieved by partially opening both of the first and second dampers 48, 50 to partially open each of the first and second air inlet ports 44, 46. In any event, the fan unit 56 of the blower 50 will experience a constant suction pressure because a constant rate of suction air will be achieved via the combined sum of the effective cross sectional areas of the first and second air inlet ports 44, 46 remaining substantially constant.

During the cold weather of winter months, significant energy will be saved by retrieving the energy that would ordinarily be lost from the motor driven air compressor; on the other hand, during the summer months, it will be recognized that there is no need to transfer the thermal energy loss of the air compressor to the interior of the building structure. Accordingly, seasonal needs can be taken into account by providing override switching to the first and second air control assemblies 100, 120 to accommodate the needs of the plant. While it is possible with the energy saving system 10 described herein to use no fresh air makeup at all during cold weather, it is believed always best to use the energy saving system 10 in a manner that incorporates some fresh air from outside the building. The use of outside air provides new makeup to the building, providing increased air changes for the interior thereof. Also, the use of outside air increases the space static pressure of the building, making it easier to keep the space clean and substantially reduces the cost for heating space that is conditioned.

The energy saving system of the present invention provides an efficient heat retrieval system without the loss of motor or compressor efficiency. In fact, because the system maintains a constant temperature and flow without static pressure resistance across the compressor, the motor and compressor will operate much more efficiently. In addition to this benefit, the building air conditioning systems will be provided with a more desirable environment at a savings of fuel. Finally, the energy saving system also serves to dampen the noise from the air compressor unit.

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. An energy saving system for collecting and distributing the thermal energy loss of an electrical apparatus serving a building structure, the system comprising:

an apparatus compartment substantially enclosing the electrical apparatus, the apparatus compartment having an air inlet port and an air exiting port;

blower means for blowing air into the air inlet port of the apparatus compartment in heat absorbing relationship with the electrical apparatus, the air exiting the apparatus compartment through the air exiting port thereof;

inlet air directing means for directing suction air to the blower means selectively from a first air source and from a second air source, the inlet air directing means comprising:

a sensing means for sensing the temperature of the air exiting from the air exiting port of the apparatus compartment, the sensing means providing a signal proportional to the sensed temperature; and an air control means for controlling the inlet air directing means to selectively draw air from the second air source, the air control means being responsive to the signal generated by the sensing means; and exiting air directing means receiving air from the air exiting port of the apparatus compartment, the exiting air directing means selectively directing the air in a first direction and in a second direction, the exiting air directing means comprising:

a sensing means for sensing a selected system temperature, the sensing means of the exiting air directing means providing a signal proportional to the sensed system temperature; and an air control means for controlling the exiting air directing means to selectively direct the exiting air in the first direction and in the second direction, the air control means of the exiting air directing means being responsive to the first signal generated by the sensing means of the exiting air directing means.

2. The system of claim 1 wherein the exiting air directing means is characterized as comprising:

an exiting air compartment having an inlet port and a first exhaust port and a second exhaust port, the inlet port receiving air exiting the air exiting port of the apparatus compartment; and wherein the first air control means comprises:

a first damper supported by the exiting air compartment, the first damper disposed near the first exhaust port and positionable in a closed mode wherein the first exhaust port is closed to air passage and positionable in an opened mode, the effective cross sectional area of the first exhaust port being determined by the position of the first damper;

a second damper supported by the exiting air compartment, the second damper disposed near the second exhaust port and positionable in a closed mode wherein the second exhaust port is closed to air passage and positionable in an opened mode, the effective cross sectional area of the second exhaust port being determined by the position of the second damper; and first linkage means connected to the first and second dampers for selectively positioning the first and second dampers in the opened and closed means so that the sum of the effective cross sectional areas of the first and second exhaust ports remains substantially constant, the linkage means responsive to the first signal generated by the first sensing means.

3. The system of claim 2 wherein the inlet air directing means is characterized as comprising:

an inlet air compartment having a first air inlet port, a second air inlet port, and an air exhaust port, the blower means disposed to draw air through the first and second air inlet ports and to effect the passage of air through the air exhaust port; and wherein the second air control means comprises:

a first damper supported by the inlet air compartment, the first damper disposed near the first air inlet port and positionable in a closed mode wherein the first air inlet port is closed to air passage and positionable in an opened mode, the effective cross sectional area of the first air inlet portion being determined by the position of the first damper;

a second damper supported by the inlet air compartment, the second damper disposed near the second air inlet port and positionable in a closed mode wherein the second air inlet port is closed to air passage and positionable in an opened mode, the effective cross sectional area of the second air inlet port being determined by the position of the second damper; and second linkage means connected to the first and second dampers for selectively positioning the first and second dampers in the opened and closed modes so that the sum of the effective cross sectional areas of the first and second exhaust ports remains substantially constant, the linkage means responsive to the second signal generated by the second sensing means.

4. The system of claim 3 further comprising:

exiting air conduit means connected to the first exhaust port of the exiting air compartment for flowing air passing therethrough to the building structure when the first damper is positioned to permit air passage through the first exhaust port.

5. The system of claim 4 further comprising:

entering air conduit means connected to the first air inlet port of the inlet air compartment for flowing air passing therethrough from the first source of air when the first damper is positioned to permit air passage through the first air inlet port.

6. The system of claim 5 wherein the first air source is the internal air of the building structure.

7. The system of claim 6 wherein the second air source is outside air so that outside air is provided to the blower means when the second damper is positioned to permit air passage through the second air inlet port.

8. The system of claim 7 wherein the second exhaust port communicates with the outside atmosphere so that air passing therethrough is dispensed to the outside atmosphere when the second damper is positioned to permit air passage through the second exhaust port.

* * * * *

UNITED STATES PATENT AND TRADEMARK OFFICE

CERTIFICATE OF CORRECTION

PATENT NO. : 4,217,952

DATED : August 19, 1980

INVENTOR(S) : James V. Kelly

It is certified that error appears in the above-identified patent and that said Letters Patent are hereby corrected as shown below:

At column 5, line 47, "thorugh" should be --through--.

At column 6, line 3, "fire" should be --first--.

Signed and Sealed this

*Twentieth* Day of *January 1981*

[SEAL]

*Attest:*

RENE D. TEGTMEYER

*Attesting Officer*

*Acting Commissioner of Patents and Trademarks*